US005335287A

United States Patent [19]

Athanas

[11] Patent Number: 5,335,287

[45] Date of Patent: Aug. 2, 1994

[54] LOUDSPEAKER UTILIZING MAGNETIC LIQUID SUSPENSION OF THE VOICE COIL

[75] Inventor: Lewis S. Athanas, West Newbury, Mass.

[73] Assignee: Aura, Ltd., Lewiston, Me.

[21] Appl. No.: 43,308

[22] Filed: Apr. 6, 1993

[51] Int. Cl.[5] ..... H04R 25/00

[52] U.S. Cl. ..... 381/197; 381/192; 381/194

[58] Field of Search ..... 381/192, 194, 197, 199, 381/158; 181/159

[56] References Cited

U.S. PATENT DOCUMENTS 4,017,694 4/1977 King ..... 381/194

*Primary Examiner*—Curtis Kuntz
*Assistant Examiner*—Sinh Tran
*Attorney, Agent, or Firm*—Frederick R. Cantor

[57] ABSTRACT

A loudspeaker is provided with a viscous magnetic fluid suspension for the voice coil, rather than the corrugated disk suspension that is conventionally used. Specially designed vent passages are formed in the magnet assembly, in order to prevent internal pressure build-ups, or subatmospheric conditions, that could cause the magnetic fluid to be blown out of the magnetic gap, in which the voice coil is located. The vent passages permit use of a relatively low viscosity fluid to be used for the fluid suspension. A fluid viscosity of about fifty (50) centipoise is contemplated.

3 Claims, 1 Drawing Sheet

LOUDSPEAKER UTILIZING MAGNETIC LIQUID SUSPENSION OF THE VOICE COIL

BACKGROUND OF THE PRESENT INVENTION

The present invention, relates to loudspeakers.

The present invention, more particularly, relates to loudspeakers which utilize liquid suspension mechanisms for the voice coils incorporated into such loudspeakers.

Conventional loudspeakers commonly comprise a magnet assembly, and a non-magnetic annular frame, extending from the magnet assembly, to support the large end of a cone-shaped diaphragm. The small end of the diaphragm cone is attached to a voice coil that extends into an annular magnetic gap, provided in the aforementioned magnet assembly.

In order to accurately locate and suspend the voice coil within the magnetic gap, the voice coil is attached to the inner edge of an annular corrugated disk, formed of a flexible fabric material. The outer edge of the corrugated disk is attached to the frame at a point near the magnet assembly, so that the voice coil is partially supported, or suspended, by the corrugated disk. The corrugated disk is sometimes identified as a 'spider'.

The magnet assembly commonly comprises a permanent annular magnet, polarized in the axial direction, and sandwiched between two magnetizable plates. One of the plates carries a cylindrical post that extends through the central space defined by the annular magnet, to form a cylindrical pole piece. The other plate has an annular opening, somewhat larger than the diameter of the post, or pole piece, such that an annular magnetic gap is formed between the post and the inner edge of the associated annular plate.

As previously mentioned, the voice coil extends into the magnetic gap. A variable A.C. signal applied to the voice coil produces a fluctuating magnetic force that interacts with the magnetic force produced by the permanent magnet assembly, whereby the voice coil is caused to oscillate axially within the magnetic gap. The cone-shaped diaphragm moves accordingly, to generate an audible output in the ambient space in front of the loud speaker.

The voice coil is designed to oscillate axially without experiencing other types of motion, such as rotation, moving obliquely to the axial direction, or moving in different directions, at different points, in the oscillation stroke. The corrugated disk is not entirely satisfactory as a coil suspension device in that the flexure resistance of the disk, or dimensional tolerances, can sometimes produce an oblique misalignment of the voice coil in the magnetic gap. The voice coil may move unevenly around its periphery, with a tendency to pitch or yaw, causing sound distortion. Should the voice coil scrape on the magnetic gap surfaces, the coil will experience premature failure.

The present invention relates to a magnetic liquid suspension means for locating and suspending the voice coil within the magnetic gap. The magnetic fluid can comprise a low viscosity oil, having microscopic particles of ironoxide, uniformly suspended therein. The oil-magnetic particle emulsion is adhered to the voice coil and to the magnetic gap surfaces, since the microscopic magnetic particles are magnetically attracted to the gap surfaces, by reason of the permanent magnetic field established across the magnetic gap. The microscopic, i.e., micron-sized, magnetic particles hold the liquid phase of the emulsion in the magnetic gap.

The use of a magnetic liquid as a suspension mechanism for the voice coil is advantageous, in that both the inner and outer surfaces of the voice coil are separated from the gap surfaces by the magnetic liquid. The voice coil is prevented from rubbing, or otherwise striking, the gap surfaces, i.e., the cylindrical post or the inner edge of the surrounding plate. Also, the magnetic liquid imposes minimal lateral restraint on the voice coil, so that the cone-shaped diaphragm, is relatively unrestrained. The cone moves according to the flexibility of its attachment to the annular frame. The large diameter end of the cone is attached to the frame by means of a molded elastomeric ring of semi-torroidal cross-section. If the elastomeric ring, and the frame, are manufactured with reasonably good precision, the cone will oscillate in essentially a true axial direction, so as to exert minimal constraint on the voice coil motion. The magnetic liquid located in the magnetic gap, will exert sufficient guidance on the voice coil, to ensure that the voice coil will move in a true axial direction.

One problem with the magnetic liquid voice coil suspension, is that the liquid has a tendency to be blown, or drawn, out of the magnetic gap, during operation, thereby depleting the quantity of liquid in contact with the voice coil. This phenomenon is due to the fact that oscillatory motion of the voice coil, produces momentary pressure changes in the atmosphere, near the end of the pole piece, and in the annular chamber, surrounding the pole piece.

As the cone-shaped diaphragm moves toward the magnetic gap, the pressure at the end of the pole piece is increased, thereby tending to blow some of the magnetic liquid out of the magnetic gap into the annular chamber surrounding the pole piece. As the cone-shaped diaphragm moves away from the magnetic gap, the annular chamber surrounding the pole piece experiences a slight volume decrease, with a corresponding slight negative pressure change. A pressure differential is set up along the length of the gap, such that some of the gap liquid may be drawn out of the gap, into the annular chamber. The present invention provides solutions, and mechanisms, for preventing the magnetic liquid from being drawn, or forced, out of the magnetic gap.

SUMMARY OF THE PRESENT INVENTION

An object of the present invention, is to provide loudspeakers.

A further object of the present invention, is, more particularly, to provide loudspeakers which utilize liquid suspension mechanisms for the voice coils incorporated into such loudspeakers.

The present invention contemplates a loudspeaker having a novel vent passage arrangement, for preventing any escape of magnetic liquid out of the magnetic gap in the magnet assembly. A first vent passage is formed through the pole piece so that during motion of the diaphragm cone towards the magnetic gap, any air trapped between the cone and the cylindrical pole piece will pass through the vent passage, rather than exerting an excessively high pressure on the magnetic liquid located in the gap alongside the inner surface of the voice coil. A second vent passage is formed through one of the magnetizable plates, so as to communicate with the annular chamber, surrounding the central pole piece. During the motion of the diaphragm cone away from the magnetic gap, air is drawn through the second vent passage into the annular chamber, thereby preventing a negative pressure change that might be produced by movement of the voice coil away from the annular chamber.

The present invention is concerned primarily with the vent passage system for preventing escape of magnetic liquid out of the magnetic gap, due to oscillatory motion of the diaphragm cone and voice coil.

In summary, and in accordance with the above-discussion, the foregoing objectives are achieved in the following embodiments.

1. A loudspeaker comprising a magnet assembly having:

an axis;

a frame extending from said magnet assembly;

a diaphragm mounted on said frame to extend across said magnet assembly axis;

said magnet assembly, comprising a cylindrical pole piece and an annular magnetizable plate, surrounding said pole piece;

said annular plate, having an inner edge, spaced from the side surface of the pole piece, to define an annular magnetic gap;

an annular voice coil means, extending from the diaphragm into the magnetic gap;

a viscous magnetic fluid adhered to the coil means and to the magnetic gap surfaces, for flotably suspending the coil means, and at the same time sealing against air flow through the gap;

a first vent passage, extending through the pole piece, for minimizing pressure changes in the space circumscribed by the coil means; and a second vent passage, extending into the magnet assembly, for minimizing the pressure differential across the magnetic gap.

2. The loudspeaker, as described in paragraph 1, wherein said diaphragm comprises:

a cone having a large end, flotably connected to the frame, and a small end, aligned with the magnetic gap;

said coil means comprising a cylindrical form extending from the small end of the cone into the magnetic gap, and an electrical winding on the cylindrical form; and said viscous magnetic fluid comprising an inner fluid layer bridging the space between the pole piece and the cylindrical form, and an outer fluid layer bridging the space between the electrical winding and the inner edge of the annular plate.

3. The loudspeaker, as described in paragraph 2, wherein said electrical winding has an axial length that is appreciably greater than the axial length of said magnetic gap; and said voice coil means being oriented, so that when the winding is in a de-energized state, said electrical winding projects out of said gap in both directions.

4. The loudspeaker, as described in paragraph 3, wherein said electrical winding has a sufficient axial length as to extend out of said gap in both directions throughout the entire stroke of said voice coil means.

5. The loudspeaker, as described in paragraph 3, wherein said electrical winding has an axial length that is at least fifty (50) percent greater than the axial length of said magnetic gap.

6. The loudspeaker, as described in paragraph 3, wherein said electrical winding has a smooth cylindrical side surface facing the inner edge of said annular plate.

7. The loudspeaker, as described in paragraph 6, wherein said electrical winding, comprises a helically wound ribbon, having a rectangular cross-section, whereby the exposed surface of said ribbon, is smooth and uninterrupted.

8. The loudspeaker, as described in paragraph 3, wherein said magnetic gap has a radial thickness of about eight-hundredths (0.08) of an inch; and said voice coil means has a radial thickness of about three-hundreths (0.03) of an inch.

9. The loudspeaker, as described in paragraph 3, wherein said magnetic fluid has a viscosity of about fifty (50) centipoise.

10. The loudspeaker, as described in paragraph 3, wherein said first vent passage, has a flow area measuring at least one-quarter (0.25) square inch; and said second vent passage, has a flow area measuring at least twelve-hundreths (0.12) square inch.

11. The loudspeaker, as described in paragraph 3, wherein said first vent passage, comprises a single hole, extending axially through the cylindrical pole piece; and said second vent passage, comprising a series of small holes located equidistant from said magnet assembly axis.

12. The loudspeaker, as described in paragraph 3, wherein said magnetic fluid constitutes the sole connection between the voice coil means and said magnet assembly.

13. A loudspeaker comprising:

an annular permanent magnet assembly, having an axis;

an annular frame, extending axially from said magnet assembly, to form an annular seat spaced radially outwardly from said axis;

a diaphragm in having an outer edge area mounted on said annular seat;

said magnet assembly, comprising an annular permanent magnet, having first and second end faces;

a first magnetizable plate, positioned flat-wise against the first end face of the magnet;

a cylindrical pole piece, extending from said first plate, through the space circumscribed by said permanent magnet;

a second magnetizable plate positioned flat-wise against the second end face of said magnet;

said second plate, having an inner annular edge spaced outwardly from the cylindrical side surface of said pole piece, to define an annular magnetic gap;

a voice coil means, extending from said diaphragm into said annular magnetic gap;

said voice coil means, having an outer annular surface, facing the inner edge of said second plate, and an inner annular surface, facing the cylindrical side surface of said pole piece;

a viscous magnetic fluid, coating the inner and outer surfaces of said voice coil means;

said magnetic fluid, being sufficiently thick, so as to bridge the annular spaces between said coil means surfaces and the gap surfaces, whereby said magnetic fluid flotably suspends said coil means, and at the same time seals against air flow through said gap;

said diaphragm and said voice coil means, forming a first chamber, at one end of the pole piece;

said plates, cooperating with the annular magnet, to form a second chamber, surrounding the pole piece in open communication with said annular gap;

a first vent passage, extending through the pole piece, to minimize pressure changes in said first chamber, during movement of the diaphragm and voice coil means; and a second vent passage, extending through said first plate, to minimize pressure changes in said second chamber.

14. The loudspeaker, as described in paragraph 13, wherein said first passage, comprises a single hole extending axially through said pole piece; and said second passage, comprising a plurality of holes extending through the first plate, equidistant from the magnet assembly axis.

15. The loudspeaker, as described in paragraph 13, wherein said coil means comprises:

a cylindrical tube, formed of thermally conductive material, and an electrical winding on said tube;

said tube, having an end edge, located within said second chamber; and said electrical winding, being axially spaced from the end edge of the tube, so that the tube has an extensive surface area in thermal engagement with the cylindrical pole piece.

16. The loudspeaker, as described in paragraph 15, wherein said cylindrical tube has an inner surface facing the pole piece, and an outer surface, facing the inner edge of said second plate; and said magnetic fluid, extending along at least the inner surface of the tube beyond opposite ends of the electrical winding to form thermal connections from said tube to said pole piece.

17. The loudspeaker, as described in paragraph 13, wherein said voice coil means, comprises, a cylindrical tube formed of thermally conductive material, and an electrical winding on said tube; and said tube, having an outer side surface, that is disconnected from the frame, whereby the viscous magnetic fluid constitutes the sole means for locating the tube within said magnetic gap.

A BRIEF DESCRIPTION OF THE DRAWINGS

DESCRIPTION OF A PREFERRED EMBODIMENT OF THE INVENTION

Figure 1:
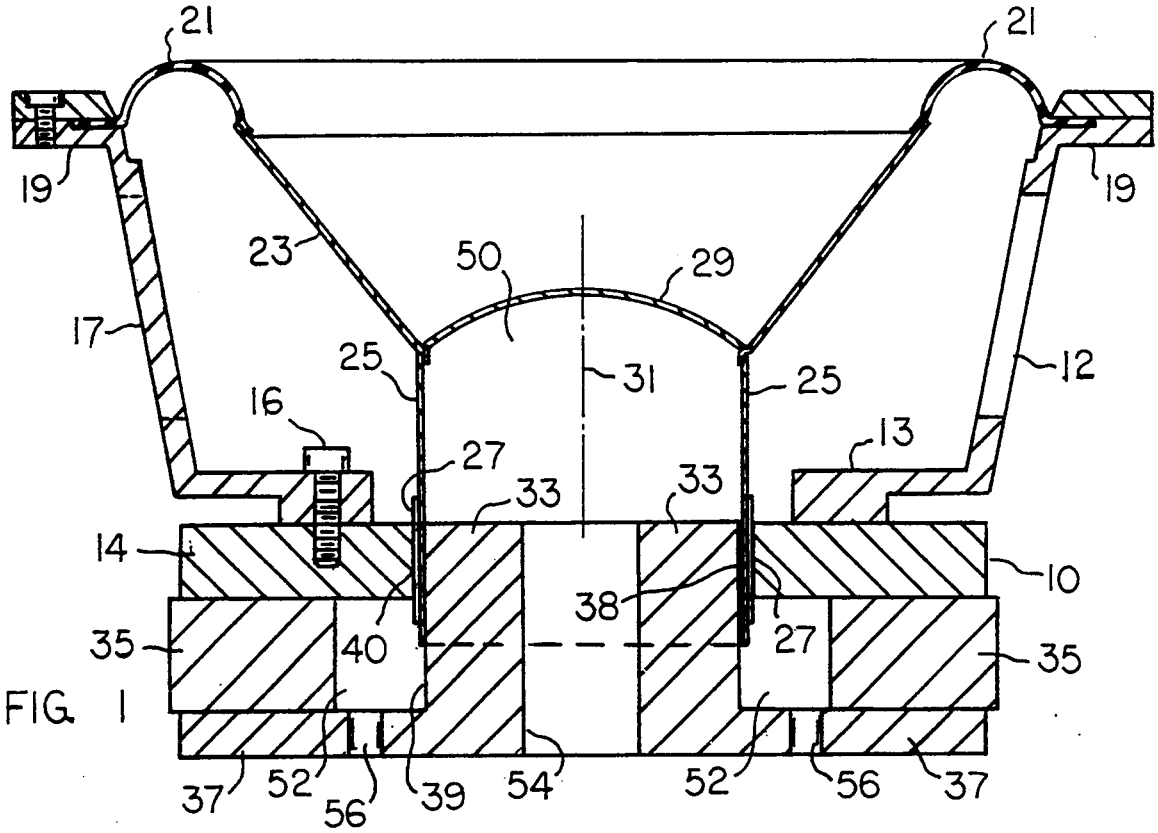
FIG. 1, is a sectional view, of a loudspeaker, embodying features of the present invention.

FIG. 1, is a sectional view, of a loudspeaker, embodying features of the present invention.

FIG. 1, shows a loudspeaker that comprises a magnet assembly 10, and a non-magnetic frame 12. The frame 12, is preferably formed of aluminum. As depicted, the frame 12, comprises an annular radial wall 13, secured to plate 14, of the magnet assembly 10, by a series of screws 16 (with only one screw 16, being shown in the drawing). The frame 12, includes three (3), or more, spokes 17, extending away from annular wall 13, to connect with an annular rim 19, that forms a seating surface for an annular molded elastomeric ring 21, sometimes referred to as the 'surround'. As viewed in FIG. 1, elastomeric ring 21, has a generally semicircular cross-section. Its inner edge is attached to the large end of a cone 23, preferably formed of thin-gauge rigid aluminum sheet material, spun into a cone configuration.

The small end of cone 23, is connected to a voice coil, that comprises a tubular form 25, and an electrical winding 27, wound on the outer surface of the form 25. Form 25, is preferably formed of a thin sheet of aluminum, rolled into a cylindrical tubular configuration.

The small end of cone 23, is closed by a light-weight cap 29, having a circular configuration. Cap 29, cone 23, and an elastomeric ring 21, collectively form a diaphragm. Elastomeric ring 21, is dimensioned, to serve as a floatlike suspension means, for the upper end of cone 23, such that the cone 23, can oscillate along central axis 31. In the de-energized state of coil winding 27, elastomeric ring 21, suspends cone 23, in a position, such that, winding 27, is axially centered in the magnetic gap formed by plate 14, and a centrally located pole piece 33.

Magnet assembly 10, comprises an annular permanent magnet 35, that is axially polarized, whereby, one end face of the magnet 35, has one polarity, and the other end face of the magnet 35, has the opposite polarity. The magnet 35, is sandwiched between the annular plate 14, and another plate 37.

A cylindrical post 33, extends from plate 37, through the central space formed within annular magnet 35, to form a centrally located pole piece. The two plates 14 and 37, and post 33, are formed of a magnetizable material, so as to define a torroidal magnetic circuit, having an annular gap 38, between the side surface 39, of the post 33, and the inner edge 40, of annular plate 14. The voice coil is located within the magnetic gap 38. Numeral 41, in FIG. 2, represents the axial length of the magnetic gap.

Figure 2:
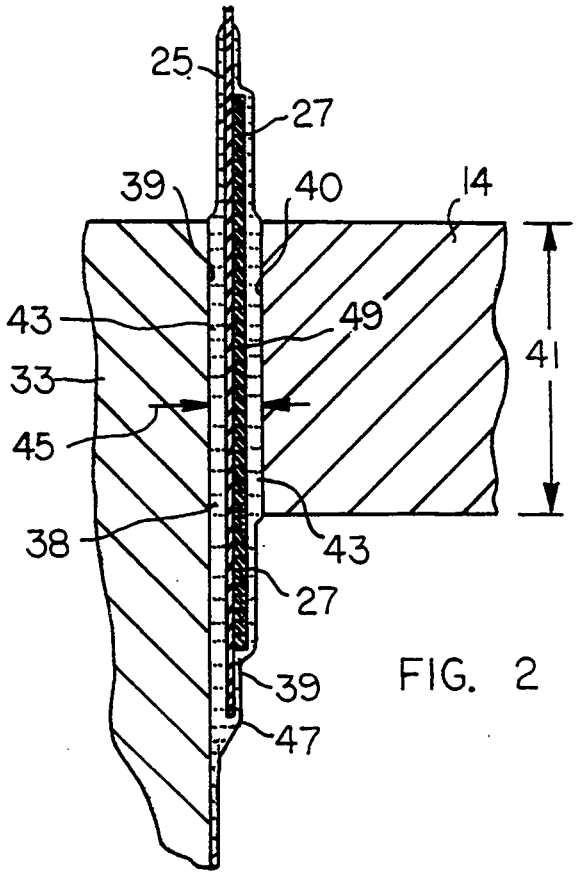
FIG. 2, is an enlarged fragmentary sectional view, of the loudspeaker, illustrating structural details, that are not apparent from FIG. 1.

FIG. 2, is an enlarged fragmentary sectional view, of the loudspeaker, illustrating structural details, that are not apparent from FIG. 1.

As seen in FIG. 2, the electrical winding 27, is axially centered in the magnetic gap 38, i.e., the upper and lower portions of the winding 27, extend out of the magnetic gap 38, an equal distance. The winding 27, is shown in its de-energized state. When an A.C. signal is applied to the coil winding 27, the coil, and associated cone 23, will oscillate axially in both directions from the neutral position, as depicted in FIG. 2. The lead wiring for the coil winding 27, will extend from the winding to insulated terminals located on frame 12.

The axial length of winding 27, is preferably at least fifty (50) percent greater that the axial length of the magnetic gap, dimension 41 in FIG. 2. The purpose of such dimensioning, is to ensure that the coil will have the same number of turns in the magnetic gap 38, in all positions of the coil. Thus, the winding 27, extends out of the gap 38, in both directions, throughout the entire stroke of the coil, in either direction. By having the same number of turns in the magnetic gap 38, throughout the coil movement, the coil is enabled to have a more linear response, with less distortion in the audio output.

A major feature of the present invention is the disposition of the viscous magnetic fluid 43, in the magnetic gap 38. The magnetic fluid 43, is preferably comprised of microscopic, micron-sized particles of iron oxide, dispersed in a low viscosity oil. The viscosity of the oil-iron oxide particle emulsion, is preferably about fifty (50) centipoise. The magnetic iron oxide particles are in sufficient concentration to achieve a magnetic intensity strength in the range of from about 600 to about 800 gauss. In service, the iron oxide particles in the emulsion will be magnetically attracted to the permanently magnetized surfaces 39 and 40, so as to maintain the magnetic liquid 43, in the magnetic gap 38, while the voice coil is either stationary, or oscillating.

Magnetic fluid 43, is used in sufficient amount to completely bridge the spaces formed between the voice coil and magnetic gap surfaces, 39 and 40. The magnetic fluid 43, forms a seal against air flow through the annular gap. A primary function of the magnetic fluid 43, is to flotably suspend the voice coil, so that the coil is prevented from contacting gap surface 39 or gap surface 40. Preferably, the voice coil is in a radially centered position, spaced equidistantly from gap surfaces 39 and 40, as shown in FIG. 2. However, the magnetic fluid 43, can perform its primary function, even though the coil is not precisely centered in the gap, i.e., if the coil is closer to one of the gap surfaces than to the other gap surface.

In a typical construction, the radial width dimension 45, of the magnetic gap, will be about eight-hundreths (0.08) of an inch. The corresponding radial thickness of the voice coil, comprised of tube 25 wall, and coil winding 27, will be about three-hundreths (9.03) of an inch. The two layers of magnetic fluid 43, will occupy the remaining five-hundreths (0.05) of an inch radial space. The viscous nature of the magnetic fluid 43, together with the presence of the emulsified magnetic iron oxide particles, will keep the magnetic fluid 43, in the magnetic gap 38, so as to prevent the voice coil from directly contacting the gap surfaces 39 and 40.

A secondary purpose of the magnetic fluid 43, is to act as a thermal connection between the voice coil and the metal members 14 and 33. Heat generated by current flow through winding 27, is dissipated through the magnetic fluid 43, thereby keeping the winding 27, reasonably cool, so that it is less likely to be damaged by temporary overloads.

Some of the heat generated in the winding 27, passes through the aluminum tube 25 wall, and the viscous fluid 43, to pole piece 33. Further, some of the heat generated in the winding 27, passes from the winding 27, through fluid 43, to metal wall 14. The iron oxide particles in the magnetic fluid 43, facilitate heat flow, through the fluid 43. In order to somewhat improve the heat dissipating action of aluminum tube 25, the tube 25, is oriented so that the coil winding 27, is spaced axially upwardly from end edge 47, of the tube 25. Heat generated in the winding 27, can flow axially from the winding 27, along the tube 25 wall, toward end edge 47, thereby placing a greater tube 25 surface area in thermal engagement with surface 39, of the cylindrical pole piece 33. The viscous magnetic fluid 43, is applied to the inner surface of tube 25, so as to extend beyond the opposite ends of the winding 27, thereby slightly improving the heat dissipating capability of the fluid 43. A coating of the fluid 43, may be applied to the voice coil by dipping the coil into a body of the viscous fluid 43, prior to installing the diaphragm on frame 12. Additionally, the magnetic fluid 43, may also be injected into the magnetic gap 38, prior to insertion of the voice coil into the magnetic gap 38.

The outer side surface 49, of winding 27, is smooth, so that the voice coil has less difficulty moving through the viscous magnetic fluid 43. A smooth coil surface can be achieved by using a rectangular cross-section insulated wire for the winding 27. As shown in FIG. 2, the wire in the winding 27, comprises a rectangular cross-sectioned ribbon, such that when the wire is wound on tubular foden 25, the flat sides of the ribbon form an essentially smooth, uninterrupted surface 49. The smooth surface 49, reduces the turbulence that could otherwise be generated in the viscous fluid 43, during oscillation of the voice coil.

As shown in FIG. 1, a chamber 50, is formed below cap 29, within the space circumscribed by coil form 25. During oscillation of the diaphragm, the volume of chamber 50, changes, i.e., the chamber volume decreases while the diaphragm is moving toward the magnetic gap 38, and the chamber volume increases while the diaphragm is moving away from the magnetic gap 38. Such volume changes will vary the pressure within chamber 50, such that the viscous fluid 43, can possibly be blown out of the magnetic gap 38. During diaphragm motion toward gap 38, an increased pressure in chamber 50 would tend to blow fluid 43, from gap 38, into annular chamber 52, formed between the magnet 35, and pole piece 33. During diaphragm motion away from gap 38, the decreased pressure in chamber 50, could pull viscous fluid 43, out of the gap 38, into chamber 50.

During oscillatory motion of the diaphragm, the lower end of the voice coil, moves into and out of annular chamber 52, thereby slightly changing the effective volume of that chamber. Such volume changes tend to produce pressure changes within chamber 52.

In order to minimize pressure changes within chambers 50 and 52, there is provided a first vent passage 54, extending within pole piece 33, and a second vent passage 56, extending through plate 37. Vent passage 54, comprises a single circular hole, extending axially through pole piece 33. The diameter of the circular hole is at least three-quarters (0.75) of an inch, which provides a flow area of about one-quarter (0.25) square inch. Vent passage 56, comprises four (4) smaller holes extending through plate 37, equidistant from central axis 31. Only two (2) of the four (4) holes 56, are visible in FIG. 1. The diameter of each smaller hole is about three-sixteenths (0.19) of an inch, which provides a total flow area of about twelve-hundreths (0.12) of an inch.

The vent passage system 56, can have a smaller flow area than vent passage 54, because chamber 52, experiences a lesser volume change than chamber 50, during oscillatory motion of the diaphragm and voice coil. The vent passage systems, are designed to substantially eliminate pressure changes that might otherwise occur in chamber 50 and 52. It has been determined that such pressure changes can cause viscous fluid 43, to be dislodged from magnetic gap 38. Vent passages 54 and 56, collectively constitute an important feature of the present invention.

The loudspeaker construction illustrated in the drawings is to be viewed as having some important advantages, including an improved power rating and relatively constant sound quality, due to the heat dissipating action of the viscous fluid 43. A further advantage resides from the fact that the viscous fluid suspension gives the voice coil a more linear response than the corrugated disk suspension, that is conventionally used. The vent passages 54 and 56, greatly minimize the potential for dislodgement of the magnetic fluid 43, from the magnetic gap 38, thereby permitting a less viscous fluid to be used in the gap 38. The low viscosity fluid 43, in turn, offers less resistance to coil motion, while at the same time providing a desired dampening action, that eliminates transient waveforms and resonances, that can adversely affect the crispness of the sound output. In preferred practice of the present invention, the viscosity of the magnetic fluid is only about fifty (50) centipoise.

The present invention is usable in various loudspeakers operating in the audio range, i.e., low frequency, high frequency, or mid-range frequency. However, the invention is particularly advantageous in loudspeakers operating in the low frequency range, where relatively large oscillatory motions of the diaphragm and voice coil are particularly useful.

The present invention describes loudspeakers that feature a viscous fluid suspension of the voice coil. Features of the present invention are recited in the appended claims. The drawings herein necessarily depict specific structural features and embodiments of the loudspeakers, useful in the practice of the present invention.

However, it will be appreciated by those skilled in the arts pertaining thereto, that the present invention can be practiced in various alternate forms and configurations. Further, the previously detailed descriptions of the preferred embodiments of the present invention, are presented for the purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A loudspeaker comprising:

an annular permanent magnet assembly, having an axis;

an annular frame, extending axially from said magnet assembly, to form an annular seat spaced radially outwardly from said axis;

a diaphragm, having an outer edge area mounted on said annular seat;

said magnet assembly, comprising an annular permanent magnet, having first and second end faces;

a first magnetizable plate, positioned flat-wise against the first end face of the magnet;

a cylindrical pole piece, extending from said first plate, through the space circumscribed by said permanent magnet;

a second magnetizable plate positioned flat-wise against the second end face of said magnet;

said second plate, having an inner annular edge spaced outwardly from the cylindrical side surface of said pole piece, to define an annular magnetic gap;

a voice coil means extending from said diaphragm into said annular magnetic gap;

said voice coil means comprising a cylindrical tube having an inner surface and an outer surface, and an electrical winging on the outer surface of said tube; said tube being formed of a thermally conductive material;

a magnetic fluid that includes an inner fluid layer bridging the space between the inner surface of said tube and the side surface of said pole piece, and an outer fluid layer bridging the space between said electrical winding and the inner annular edge of said second plate;

the outer surface of said tube being completely disconnected form said second plate whereby the magnetic fluid constitutes the sole means for locating said tube within the magnetic gap;

said diaphragm and said voice coil means forming a first chamber at one end of the pole piece;

said plates cooperating with the annular magnet to form a second chamber surrounding the pole piece in open communication with said annular gap;

a first vent passage means extending through the pole piece, to minimize pressure changes in said first chamber, during movement of the diaphragm and voice coil means;

a second vent passage means extending through said first plate, to minimize pressure changes in said second chamber;

said tube having an end edge located within said second chamber; and said magnetic fluid having a viscosity of about fifty (50) centipoise; said magnetic fluid comprising micron-sized magnetic particles in sufficient concentration to achieve a magnetic density in the range from about 600 to about 800 gauss.

2. The loudspeaker of claim 1, wherein said electrical winding has an axial length that is at least fifty (50) percent greater than the axial length of said magnetic gap, so that the winding extends out of said gap in both directions throughout the entire stroke of said voice coil means.

3. The loudspeaker of claim 2, wherein said electrical winding comprises a helical wound ribbon, said ribbon having a square cross-section whereby the exposed side surface of said ribbon is smooth and uninterrupted.

* * * * *